United States Patent [19]

Terbeek

[11] 4,105,242

[45] Aug. 8, 1978

[54] MOBILE CHAIR

[76] Inventor: Howard G. Terbeek, 19258 Briarwood La., Strongsville, Ohio 44136

[21] Appl. No.: 773,601

[22] Filed: Mar. 2, 1977

[51] Int. Cl.[2] ..... A61G 1/02

[52] U.S. Cl. ..... 296/20; 280/30; 280/640

[58] Field of Search ..... 280/30, 242 WC, 640, 280/643; 180/DIG. 3; 5/81; 296/20

[56] References Cited

U.S. PATENT DOCUMENTS

| | | | |
|---|---|---|---|
| 2,747,919 | 5/1956 | Ferneau et al. | 296/20 |
| 2,877,047 | 3/1956 | Weil | 296/20 |
| 3,057,655 | 10/1962 | Weil et al. | 296/20 |
| 3,112,001 | 11/1963 | Wise | 280/30 |
| 3,137,511 | 6/1964 | Weil et al. | 280/30 |
| 3,669,031 | 6/1972 | Cole | 108/50 |
| 3,759,565 | 9/1973 | Ferneau | 296/20 |
| 3,889,963 | 6/1975 | Brattgard | 297/DIG. 4 |
| 3,964,786 | 6/1976 | Mashuda | 280/242 WC |

*Primary Examiner*—Joseph F. Peters, Jr.
*Assistant Examiner*—Donn McGiehan
*Attorney, Agent, or Firm*—Price, Heneveld, Huizenga & Cooper

[57] ABSTRACT

A cart convertible between a chair position and a bed position includes a horizontal seat frame pivotally coupled to a leg rest frame, a back frame, and four depending legs. The forwardmost pair of the depending legs and the back frame are coupled by an adjustment means for simultaneously raising the forward pair of legs and lowering the back frame toward a horizontal position thereby facilitating rolling the cart onto a raised platform having limited vertical clearance such as onto the loading gate of a station wagon. The rearward most pair of the depending legs can also be raised toward a horizontal position thereby facilitating positioning of the entire cart on the raised platform.

19 Claims, 14 Drawing Figures

MOBILE CHAIR

BACKGROUND OF THE INVENTION

1. Field of the Invention

This invention relates to a cart adjustable between a chair position and a bed position and an interlocking support frame to permit the cart to be slid onto a raised platform with restricted overhead clearance.

2. Prior Art

The problems of transporting an invalid either in a sitting position or in a reclining position from one location to another location are well known. For movement through narrow doorways, narrow halls and narrow stairways, a chair configuration is easier for maneuvering than is a stretcher configuration. Moving a patient from ground level to a raised platform is typically easier with a stretcher configuration. For example, if the raised platform is the back of a station wagon or ambulance, maintaining a chair configuration would probably require removing a passenger seat and increasing head room to compensate for the increase in height of the chair over the passenger seat.

More particularly, the prior art teaches invalid chairs which have reclining back rests and adjustable leg rests thereby converting a chair into a substantially horizontal platform. The prior art also teaches special chairs which act in cooperation with specially constructed vehicle interiors to provide for receiving and securing the special chair within the vehicle. However, such systems have been generally relatively complex, expensive and suited only for specially equipped cars.

The prior art also teaches ambulance carts having collapsible legs. Typically, all the legs of the cart collapse simultaneously as the cart is positioned on the raised platform. Also, typically, no provision is made for providing a sitting position for the cart occupant. The ambulance carts have commonly required a substantial supporting and guiding force while the cart is being positioned on the raised platform and the legs are being collapsed. These are some of the drawbacks which this invention overcomes.

SUMMARY OF THE INVENTION

This invention recognizes the need for a transport means convertible between a chair configuration and a bed configuration and having the ability for controlled and relatively effortless movement from the ground onto a raised platform with a limited overhead clearance, such as the back of a station wagon or ambulance. In particular, the invention recognizes that the transition in changing the support for the transport means from the ground to the raised platform is particularly critical. In accordance with an embodiment of this invention, the operator guiding an occupied cart must provide only guiding forces and need not provide supporting forces for the cart.

A cart convertible between a chair position and a bed position has a forward and a rearward pair of legs, and a chair back frame coupled to the forward pair of legs by an adjustment means. By operating the adjustment means, the chair back frame and the forward pair of legs can be adjusted simultaneously toward a generally horizontal position thereby facilitating controlled positioning of the cart onto a raised platform with limited overhead clearance. The adjustment means can include a handle positioned rearward of the chair back frame which can be used for guiding the cart when it is in the chair position or the bed position.

Advantageously, in accordance with one embodiment of this invention, the cart includes a leg rest frame pivotally coupled to a seat frame so it can be swung to a relatively horizontal position and positioned on the raised platform. Extending downward from the leg rest frame are auxiliary wheels or rollers for easing travel across the platform. Similarly, auxiliary wheels extend downward from the seat frame adjacent the forward and rearward pairs of legs to facilitate movement of the cart across the raised platform in the bed configuration with legs retracted. An embodiment of this invention can also include a length adjustment of the rearward pair of legs. For example, the rearward pair of legs can include longitudinally telescoping tubes to increase the length of the rearward legs from a normal chair height to a loading height thereby raising the rear of the transport means when the leg rest frame is positioned on the raised platform and facilitating loading of the transport means on the raised platform.

DETAILED DESCRIPTION OF THE INVENTION

Figure 3:
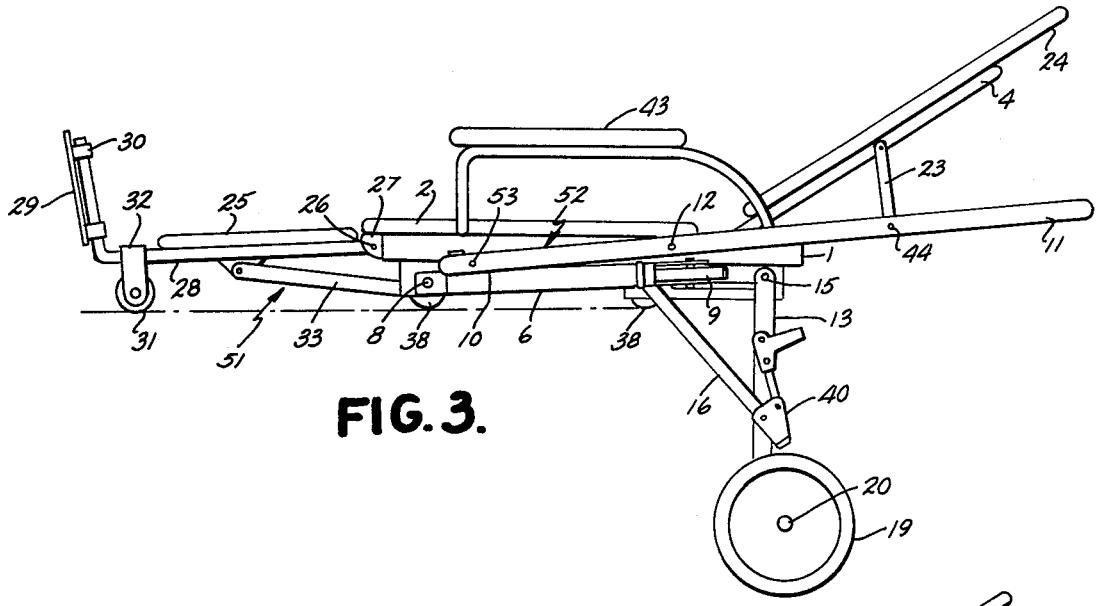
FIG. 3 is a side elevation view of the cart shown in FIG. 1 with the leg frame raised, the front legs retracted, and the back frame lowered.
Figure 4:
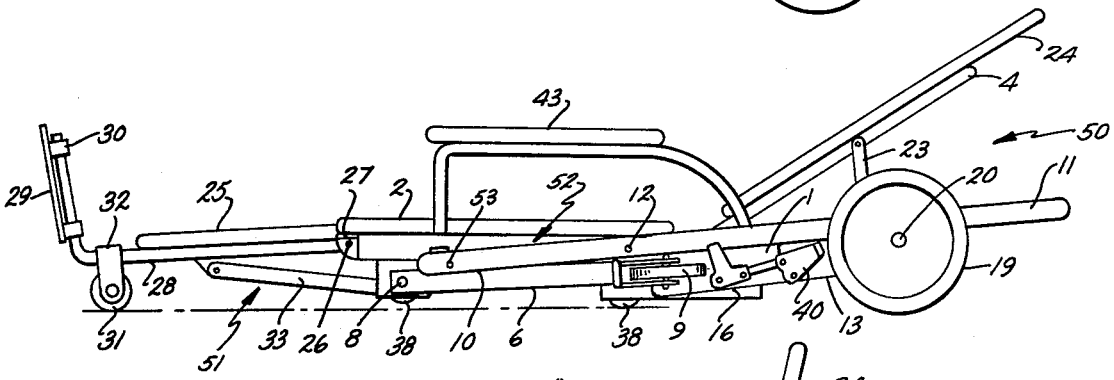
FIG. 4 is a side elevation view of the cart shown in FIG. 1 with the leg frame raised, the front legs retracted, the back frame lowered and the rear legs retracted.
Figure 5:
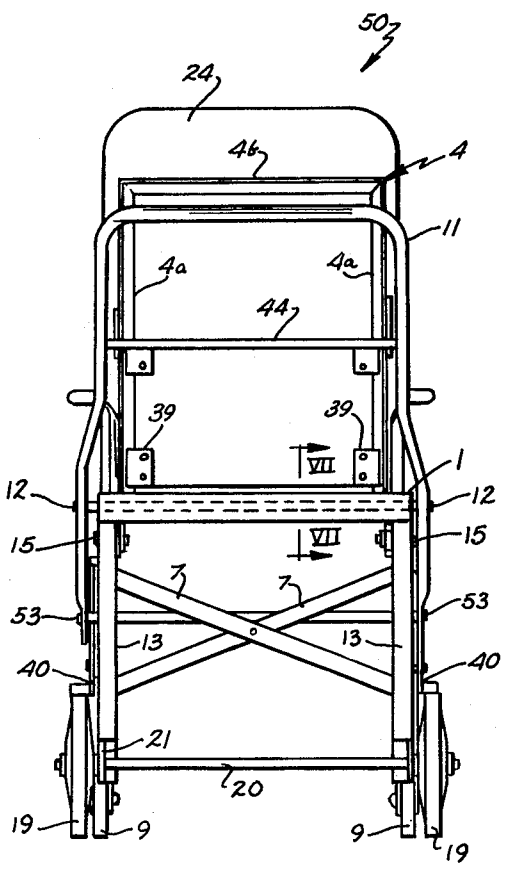
FIG. 5 is a rear elevation view of a cart in accordance with the embodiment of this invention shown in FIGS. 1–4 with the back frame raised and the front and rear legs lowered.

Referring to FIGS. 1–5, a cart 50 includes a horizontal seat frame 1 having a generally rectangular configuration with four corner extremities. A leg support frame 28 is pivotally mounted to a forward portion of seat frame 1 and can be positioned between a lowered and a raised position by a leg frame adjustment mechanism 51 connected between seat frame 1 and leg support frame 28. A pair of elongated rear legs 13 depend downwardly from a rearward portion of the sides of seat frame 1. Rear legs 13 are pivotally mounted to seat frame 1 so they can be retracted upward toward a horizontal position. A pair of elongated front legs 6 are pivotally mounted to a forward portion of seat frame 1. A back frame 4 is pivotally coupled by pins 5 to a rearward portion of seat frame 1 and includes two side portions 4*a*, one side portion 4*a* extending from each side of seat frame 1, and a traverse portion 4*b* connecting the extremities of side portions 4*a* (FIG. 5). A primary cart conversion mechanism 52 includes an elongated U-shaped handle 11 extending transversely behind back frame 4 and diagonally downward adjacent the side of seat frame 1 to front legs 6. Handle 11 is pivotally coupled to seat frame 1, back frame 4 and front legs 6. Operation of handle 11 simultaneously lowers back frame 4 and raises front legs 6.

Seat frame 1 has a pair of arm rests 43 connected to the sides of seat frame 1. Arm rests 43 include an elongated structural support means connected to seat frame 1 at its extremities and supporting an elbow pad at an intermediate position. A generally rectangular seat 2 rests on seat frame 1 and typically includes a rigid planar supporting member and a cushioned covering material. Seat frame 1 further includes four wheels 38 extending downward from four spaced locations approximately corresponding to the four corners of seat frame 1. Wheels 38 extend sufficiently downward from the remainder of seat frame 1 to permit rolling support of seat frame 1, and wheels 38 are aligned to permit forward and rearward movement of seat frame 1. A back 24 is connected to back frame 4 by a set of blocks 39 (FIG. 5) which overlap and engage back frame 4 so back 24 may be raised or lowered to provide an adjustment of the back. Back 24 typically includes a generally rectangular, rigid planar supporting member and a cushioned covering material.

Leg support frame 28 includes two downwardly depending elongated members pivotally coupled at their top extremity by hinge pins 26 to brackets 27 mounted on the front of seat frame 1 and having an angled extension at their lower extremity for supporting a foot rest 29. A leg support 25 is a generally planar panel which extends transversely between the two downwardly depending members of leg support frame 28. Foot rest 29 is a planar member extending generally perpendicularly from the lower angled portion of leg support frame 28. Advantageously, foot rest 29 is coupled to leg support frame 28 by hinges 30 thereby permitting foot rest 29 to be pivoted out of the way to facilitate an occupant of cart 50 getting into or out of cart 50. An auxiliary wheel 31, similar to wheels 38 on seat frame 1, is coupled to leg support frame 28 by a bracket 32. Wheel 31 extends downwardly when leg support frame 28 is pivoted to a generally horizontal position and thus acts to support leg support frame 28. Leg support frame 28 can include telescoping members so it is adjustable for length.

Figure 8:
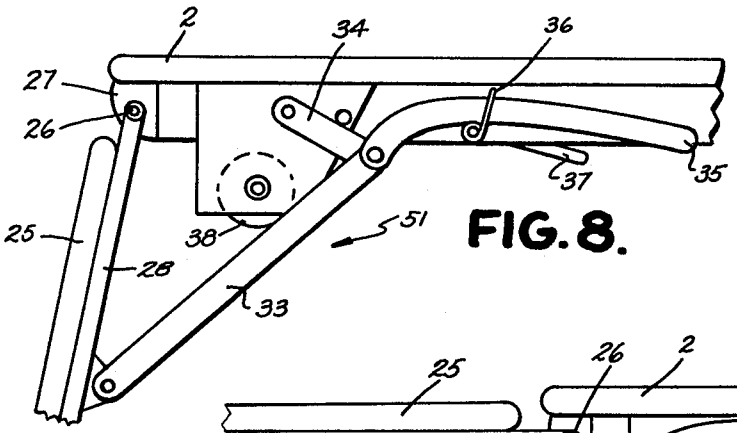
FIG. 8 is a side elevation view of the leg frame adjustment mechanism in accordance with an embodiment of this invention when the leg frame is in the lowered position.
Figure 9:
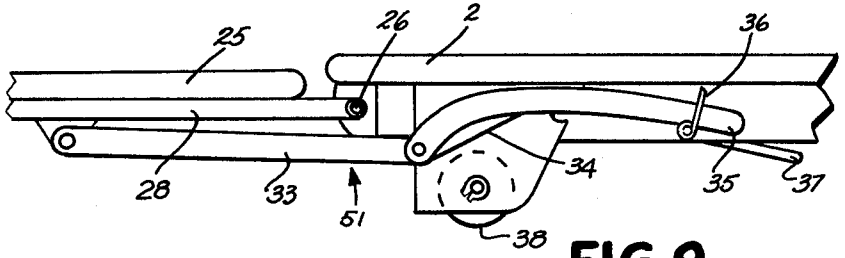
FIG. 9 is a side elevation view of the adjustment mechanism shown in FIG. 8 with the leg frame in a raised position.

Referring to FIGS. 8 and 9, leg frame adjustment 51 includes an elongated primary link bar 33 pivotally coupled at one extremity to leg support frame 28, an elongated secondary link bar 34 pivotally coupled between seat frame 1 and the other extremity of primary link bar 33, and and adjustable lock bar 35 pivotally coupled to the pivotal connection of primary link bar 33 and secondary link bar 34. Lock bar 35 slides through a slot in a lock plate 36 pivotally mounted on seat frame 1. Lock plate 36 can be a generally planar member with the slot being generally perpendicular to a major surface. Lock plate 36 pivots to permit adjusting lock bar 35 to slide freely through the slot in lock plate 36 when leg support frame 28 is being raised and lock plate 36 pivots to a position restricting the sliding of adjusting lock bar 35 when downward pressure is applied to leg support frame 28. A release lever 37 coupled to lock plate 36 can be rotated to restore free movement of lock bar 35 within the slot of lock plate 36, thereby permitting lowering of leg support frame 28.

A set of parallel tubular front legs 6 are connected to the forward underside of seat frame 1 with pivot pins 8 (FIGS. 1–4). Advantageously, front legs 6 are laterally connected by welded cross braces 7 (FIG. 5) which intersect between legs 6, one of the cross braces extending from the top of left leg 6 to the bottom of right leg 6 and the other of the cross braces extending from the top of right leg 6 to the bottom of left leg 6. A swivel caster 9 is inserted into the end of each leg 6. Handle 11 extends from a hinged extension on the rear of one front leg 6 diagonally upward along one side of the cart 50, then behind and transversely across back frame 4 and diagonally downward along the other side of cart 50 to a hinged extension on the rear of the other of front legs 6. The sides of handle 11 are connected at a pivot point 12 to seat frame 1. Between the transverse portion of handle 11 and pivot point 12, handle 11 is connected to back frame 4 by a link bar 23. The connection at each end of link bar 23 is pivotal. Each forward (lower) end of handle 11 includes an extension 10, the forward end of which is connected by pivot pin 14 to a bracket 60 mounted on leg 6. Both sides of handle 11 are connected pivotally to the extensions 10 by a bar 53*a* extending between joints 53. When the front legs 6 are being raised, the portion of handle 11 between joint 53 and pivot point 12 rotates upward and forward, and the extension 10 rotates backward and upward. A catch 54*a* connected to handle 11 at joint 53 locks handle 11 and extension 10 in straight alignment. When released it allows rotation of handle 11 about joint 53 thus causing movement of primary cart conversion mechanism 52. When the legs 6 are fully raised, a pair of catches 46 (FIG. 2) lock the bar 53*a* against the bottom of the frame 1.

Rear legs 13 are elongated and have an upper end pivotally and slidably coupled by a pin 15 to a horizontal slot 58 extending along the bottom rear portion of seat frame 1. Catches 41 are pivotally mounted to restrain movement on pin 15 in one direction and to swing clear and allow pin 15 to pass in another direction. A pair of wheels 19 are mounted on an axle 20 extending through brackets 21 attached to the bottom portions of rear legs 13. A pair of elongated braces 16 are connected to the frame by pivot pin 17 and to rear legs 13 by pins 18. Braces 16 support the rear legs in the normal vertical position when pins 15 are locked at the rear ends of the slots 58 in the frame by catches 41. A rear wheel brake assembly 40 is pivotally connected to rear legs 13 so that in one configuration it engages and restrains wheel 19. When the configuration is changed wheel 19 is free to rotate.

Figure 6:
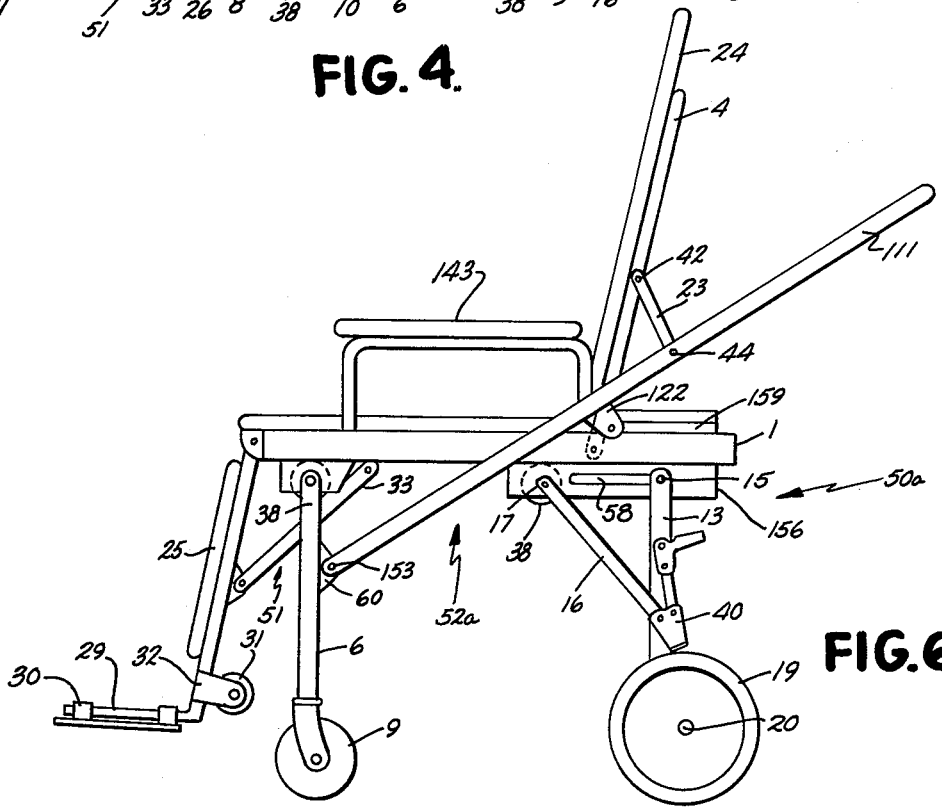
FIG. 6 is a side elevation view of a cart in accordance with a second embodiment of this invention having a different back frame adjustment mechanism from the embodiment shown in FIGS. 1–5.
Figure 7:
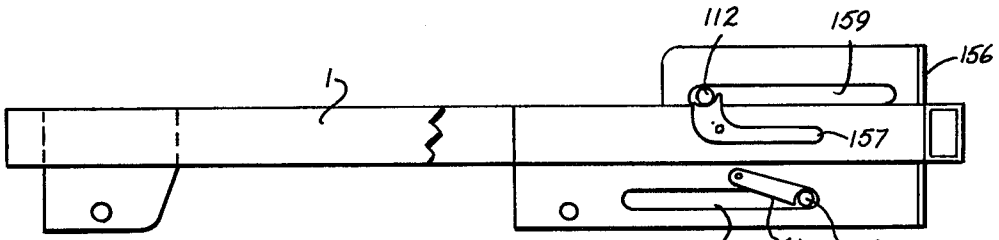
FIG. 7 is a side elevation view of a portion of a seat frame of the embodiment shown in FIG. 6 taken generally along section line VII—VII in FIG. 5.

Reference is now made to FIGS. 6 and 7 for a description of a second embodiment of this invention designated a cart 50*a*. Where like numerals are used they indicate like parts in common with other embodiments of this invention. Basically, a primary cart conversion mechanism 52*a* is somewhat modified and the connection of an arm rest 143 is moved to accommodate this modification. A handle 111 has a single side member omitting joint 53 and catch 54*a* of handle 11. Additionally, pivot coupling point 12 is omitted and each downwardly extending leg of handle 111 has welded to it a protruding bracket 122 so a rod 112 connecting the ends of the brackets crosses the seat frame 1 behind back frame 4. Rod 112 passes through a pair of horizontal slots 159 within plates 156 attached to each of the inner sides of seat frame 1. Slots 159 cooperate with a pivotally mounted releasable catch 157 for securing rod 112 in the forward ends of the slots 159 thus positioning handle 111 so front legs 6 are in a vertical position. Arm rest 143 is connected to frame 1 forward of plate 156 and is otherwise similar to arm rest 43.

Reference is now made to FIGS. 10–14 for a description of a third embodiment of this invention designated a cart 50*b*. As before, where like numerals are used they indicate like parts in common with other embodiments of this invention. Briefly, this embodiment uses a screw drive to raise a leg rest, a screw drive to vertically extend the rear pair of legs, pivotal connections to the side arm rests to facilitate lowering of the arm rests, and modification of the means for bracing and rotating the rear leg assembly.

Figure 11:
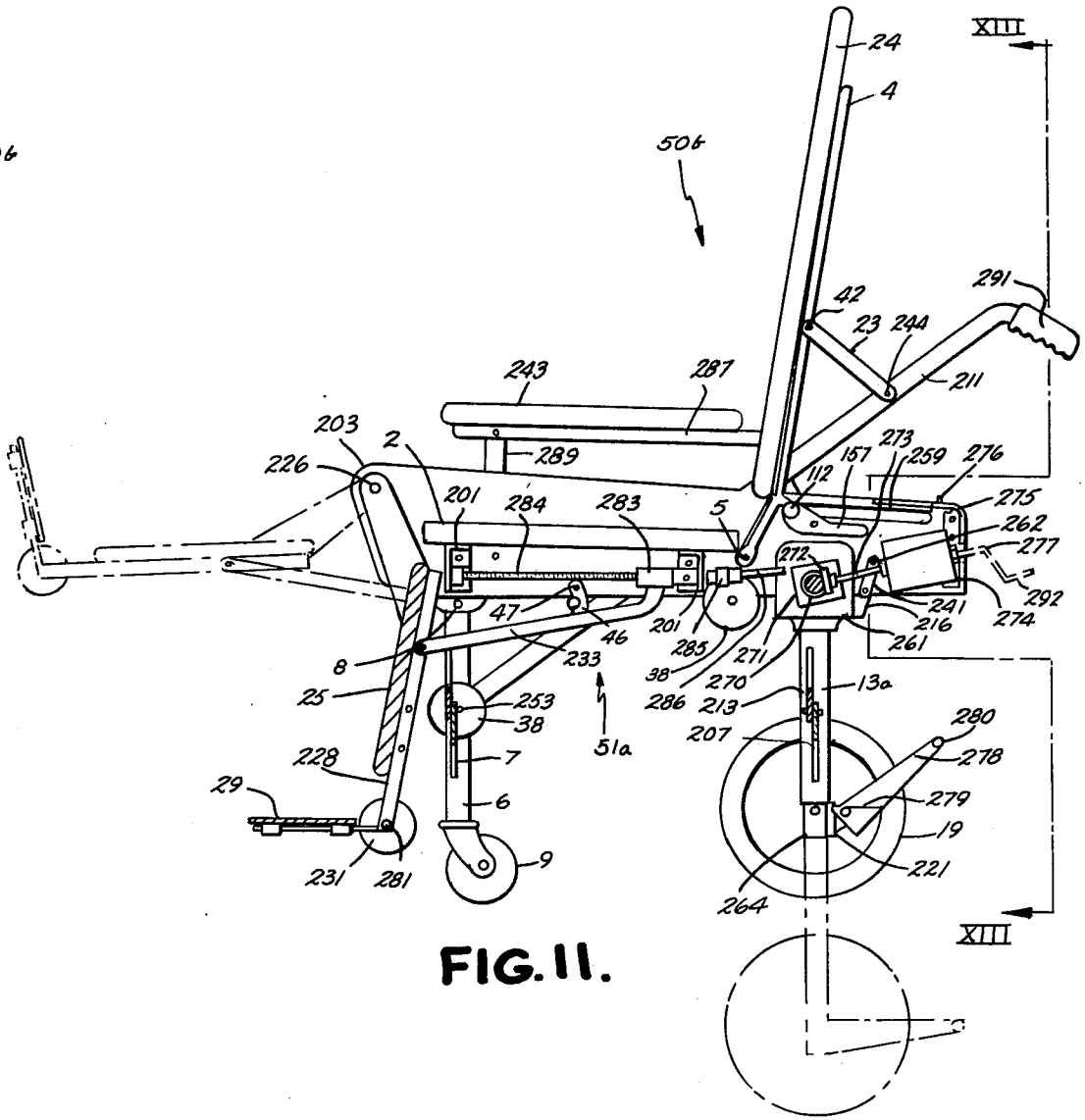
FIG. 11 is a partly broken away side elevation view of the embodiment of FIG. 10 showing, in phantom lines a raised leg rest and a downwardly extended rear leg.
Figure 12:
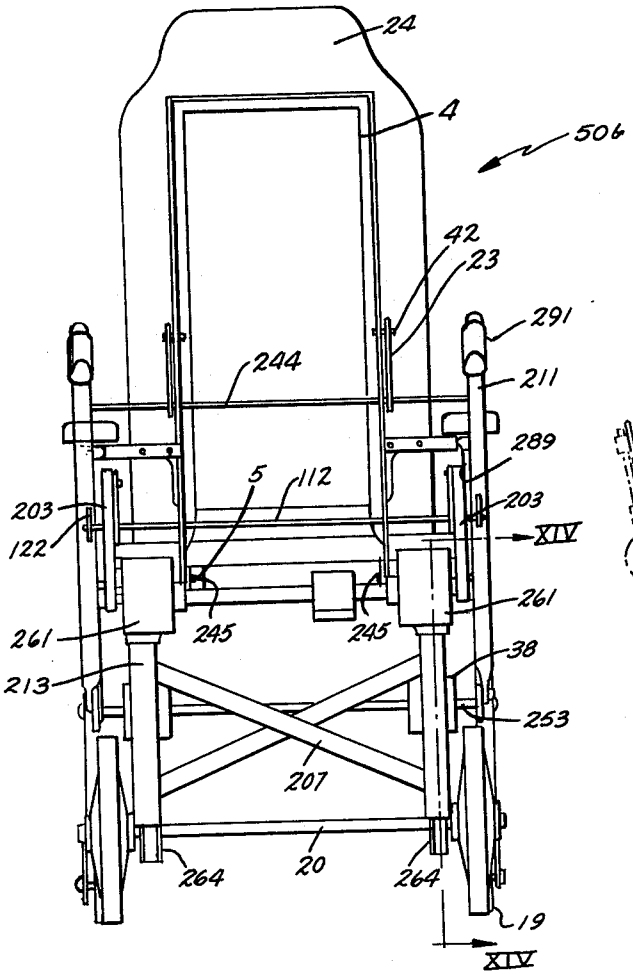
FIG. 12 is a rear elevation reduced view of the embodiment shown in FIGS. 10 and 11.

Referring to FIG. 11, seat 2 is mounted on a pair of transverse metal frame members 201 between two side panels 203. A cushioned back 24 is attached to back frame 4. The lower ends of back frame 4 are pivotally connected by hinge pins 5 to brackets 245 (FIG. 12) wich are attached to the rear of frame member 201, such that back frame 4 can be adjusted between a generally vertical position and a reclining, generally horizontal position.

Two front legs 6, connected by rigid cross braces 7, are connected by hinge pins 8 (FIG. 10), to the bottoms of side panels 203 near the front. A cross bar 253 connects the midpoints of front legs 6 and is used to mount a pair of small wheels or rollers 38. Rollers 38 are used to provide rolling support for cart 50*b* when front legs 6 are retracted. Inserted in the bottom of each front leg is a swivel caster 9. The legs are connected to the chair such that they can be raised from a normal vertical position through approximately 90° to a horizontal position, in which position a pair of releasable catches 46 (FIG. 11) connected by pivot pins 47 to the insides of the side panels 203 engage cross bar 253, to lock the front leg assembly in the raised or retracted position.

Along each side of the cart is a tubular metal handle 211 with a bracket 122 extending from the underside of handle 211. Connecting the two brackets 122, one on each side, is elongated rod 112, which passes through a horizontal slot 259 in each of side panels 203. A pair of releasable latches 157, lock rod 112 in position at the forward ends of the slots 259, thereby holding front legs 6 in the normal, generally vertical, position. The lower forward end of each handle 211 is connected by a hinge pin 14 to a bracket 60 which is attached to the rear of front leg 6 just above midpoint. The upper rear end of each handle 211 is bent downward and has a molded rubber or plastic handgrip 291 mounted on it. Pivotally connecting each of the two handles 211 to back frame 4 is elongated link bar 23.

Each rear leg assembly 13*a* is extendable and comprises an outer tube 213 topped by a gear box 261 (FIG. 11). The gear box has a fixed pivot pin 215 (FIG. 10) which extends through the side panel 203 and about which pivoting of rear legs 13*a* takes place. Attached to the rear of each gear box is a bracket 216 with a releasable springloaded catch 241 (FIG. 11) which engages a stud 262 extending inwardly from side panel 203 to hold leg 13*a* in a normal vertical position. Catch 241 can be similar in operation to catch 41. Outer tubes 213 of the two legs 13*a* are connected by cross braces 207. Each rear leg has an inner tube 264 (FIGS. 12, 13) which slides longitudinally in the outer tube 213. Fastened in the top end of the inner tube 264 is a plug 265 (FIG. 13) with a threaded hole through which extends an elongated leg screw 266. A typical screw can be about one-half inch in diameter. The top end of the screw is connected to a bevel gear 267. Rotation of bevel gear 267 by a mechanical linkage described below extends or retracts the inner tube 264 within outer tube 213. Inner tubes 264 are rotationally stabilized with respect to outer tube 213 by axle 20.

Mating with bevel gear 267 is a bevel gear 268 connected to an elongated drive rod 269, which extends inward to a differential gear 270 (FIG. 11) enclosed in a differential gear case 271 (FIG. 11). The longitudinal axis of drive rod 269 is aligned to be concentric with the longitudinal axis of pivot pin 215, such that rear legs 13*a* can be turned about the pivot point, i.e. raised, with minimal effect on the leg gear mechanism. For example, if drive rods 269 remain stationary while the legs are raised, the result is less than one full turn of the leg screws 266.

Two differential gears 270 engage a drive gear 272 (FIG. 11) connected by a drive shaft 273 to a motor 274, such as, for example, a 12-volt, d.c., reversible motor operable at approximately 300 r.p.m. Motor 274 is mounted inside, but electrically insulated from, a metal panel 275 (FIG. 11) which connects side panels 203 at the rear. Since raising and lowering the cart is required only when loading or unloading from a car, the necessary power can be taken from the car's electrical system by means of an extension cord that can plug into a cigarette lighter socket or be connected permanently into the electrical system at the rear of the car. Panel 275 goes across the back end and part way forward on top of side panels 203 far enough to cover motor 274 and differential case 271. Differential case 271 is supported by mounting brackets (not shown) attached to the rear panel. A two-terminal, polarized electrical connector can be installed in rear panel 275 or in side panel 203 for receiving the electric power cord. Wires from the connector terminals can be connected to motor 274 through a switch 276. Advantageously, such a switch is a double-pole, double-throw switch with a spring return to a center off position located between a raise position and a lower position. The rear end of the motor drive shaft has a socket connector 277 (FIG. 11) into which a hand crank 292 (shown in phantom lines in FIG. 11) can be inserted, if necessary, to operate the drive mechanism manually. Alternative means for extending rear legs 13*a* include combinations of cable and winch, chain and sprocket, rack and pinion, and screw with chain or gear drive.

Rear wheels 19 are mounted on an axle 20 which extends through the lower ends of the inner tubes 264. Also attached to the lower end of each inner tube 264 is a bracket 221 on which is mounted a pivot arm 278. A spring 279 holds the arm at approximately 45° to horizontal but allows it to move downward to a stop position when horizontal (shown in FIG. 11). A cross bar 280 connects the ends of pivot arms 278 and acts as a foot bar to assist in maneuvering the chair as may be required.

A hinged leg support assembly 51*a* is connected to the front of the chair. A support panel 25 is mounted on a pair of spaced elongated frame members 228 which are connected by hinge pins 226 near the upper forward corners of the side panels 203. Frame members 228 are longitudinally extendable, each having an angled extension at the lower extremity on which a metal foot plate 29 is hinged. Connecting the lower angle corners of frame members 228 is traverse axle 281 on which a set of small wheels 231 is mounted. Attached to each of frame members 228 by a pivot pin 282 is one end of an elongated link bar 233 which is connected at the other end to a screw follower 283. Screw follower 283 is coupled to an elongated screw 284 which is supported between seat frame members 201 midway between side panels 203. The rear end of screw 284 is connected by a flexible connector 285 to a rod 286 extending through rear panel 275 to a hand crank (not shown) similar to crank 292.

Figure 10:
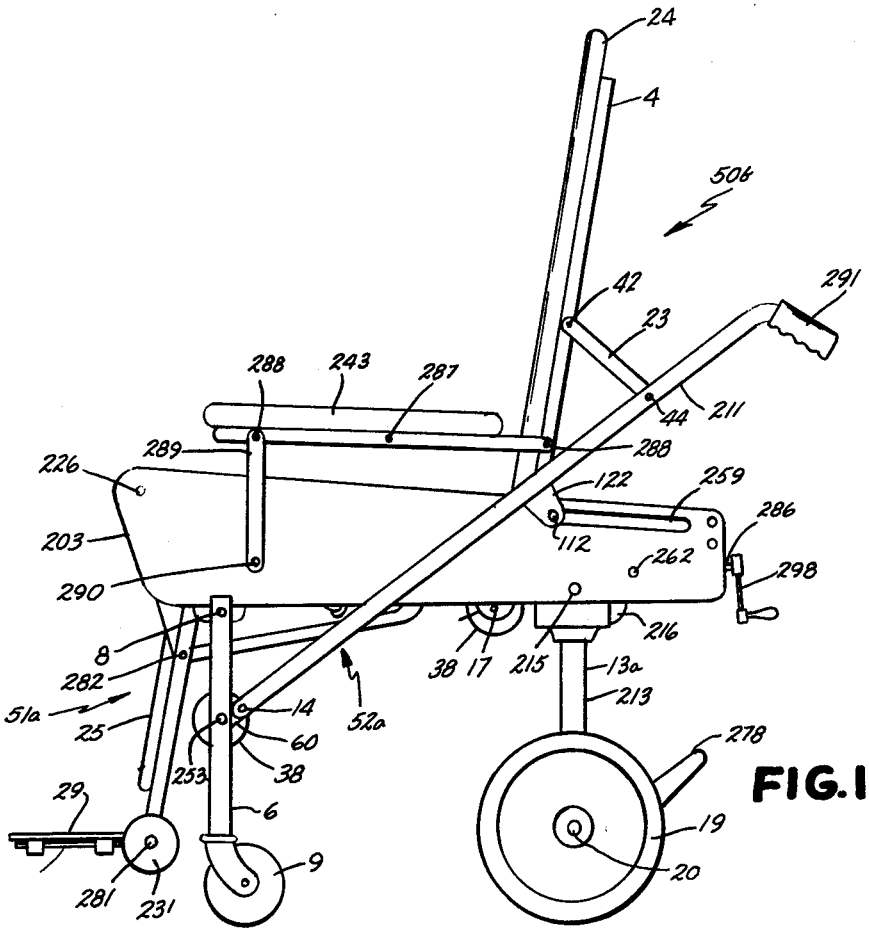
FIG. 10 is a side elevation view of a third embodiment of this invention having a different back frame adjustment mechanism, a different leg support frame adjustment mechanism, and a different rear leg retraction mechanism.
Figure 13:
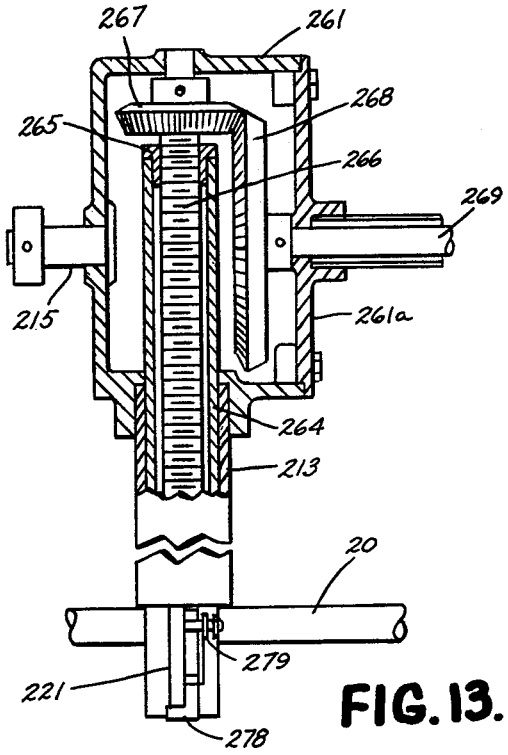
FIG. 13 is a partial, broken longitudinal cross section view along line XIII—XIII of FIG. 11.
Figure 14:
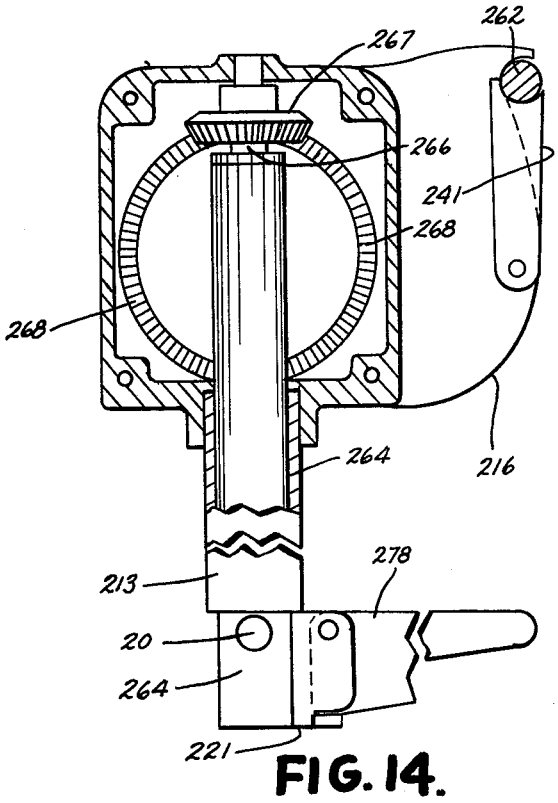
FIG. 14 is a partial broken longitudinal cross section view along line XIV—XIV of FIG. 12.

On each side of the chair shown in FIG. 10 is an arm rest 243 mounted on a metal frame 287 the rear end of which is connected by a pivot pin 288 to back frame 4. The forward part of frame 287 is connected by a pivot pin 288 to a pivotable support arm 289. The lower end of support arm 289 is connected by pivot pin 290 to side panel 203. This arrangement permits the arm rests to follow the back support when the latter goes into the reclining position. Although the invention has been described using metal for support components, other structural materials can be used.

A further embodiment of this invention can include longitudinally extendable front legs. Such front legs can have an extension mechanism similar to that of the rear legs, and these mechanisms can be coupled so that all four legs would extend or retract simultaneously. Thus, the height of the cart can be adjusted to further ease moving the cart between a raised platform and ground level. However, the front leg assembly and rear leg assembly would pivot independently from vertical to horizontal positions.

OPERATION OF THE INVENTION

Figure 1:
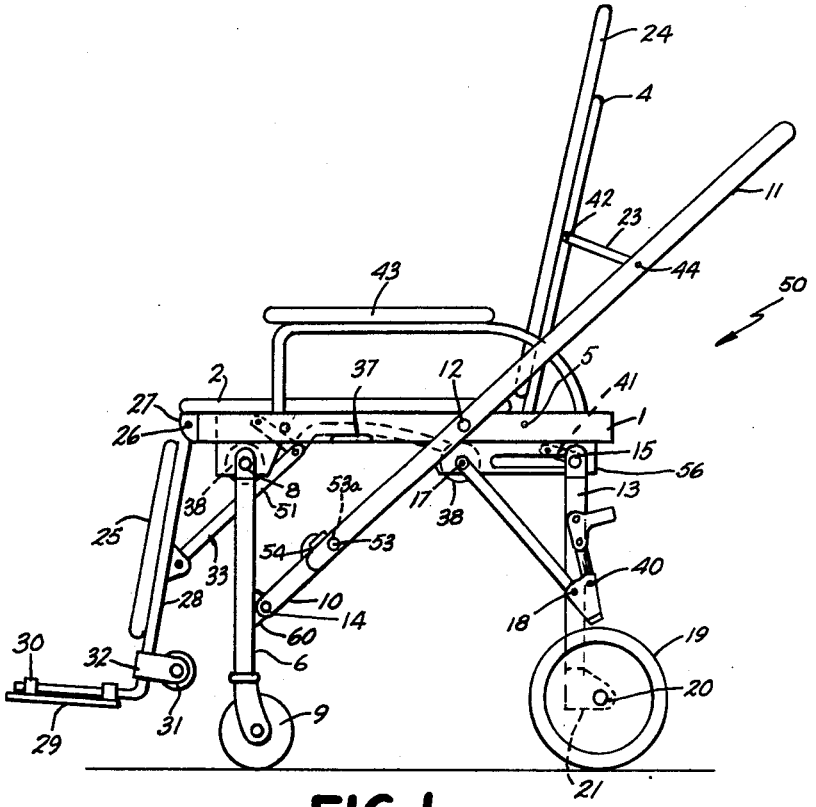
FIG. 1 is a side elevation view of a cart in accordance with an embodiment of this invention adjusted to be in a chair position.
Figure 2:
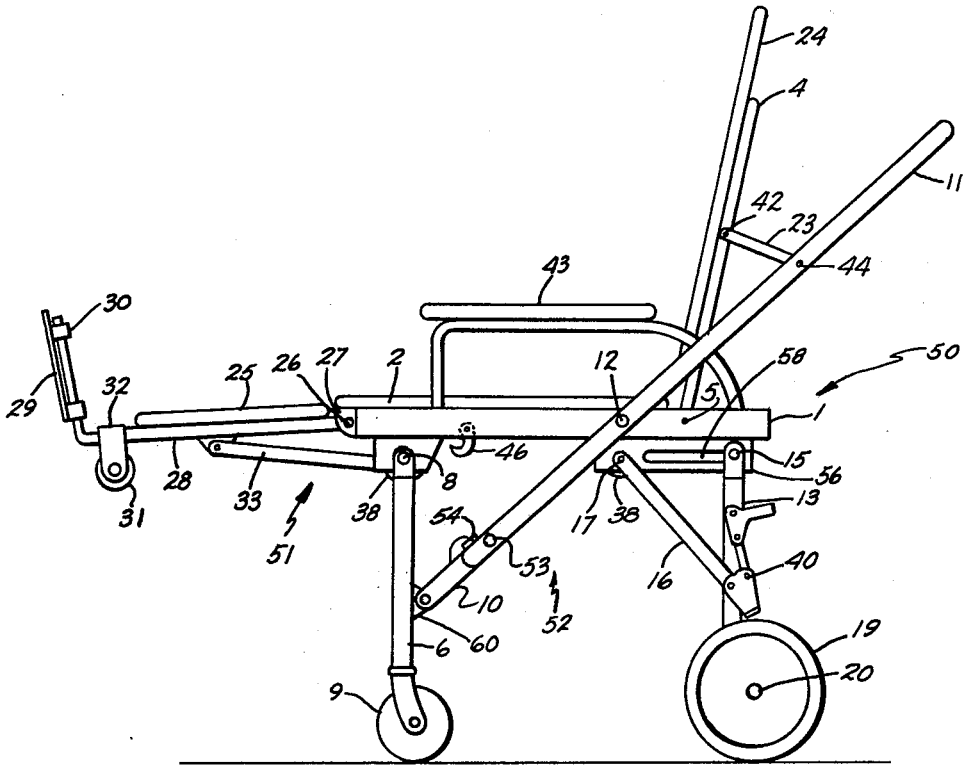
FIG. 2 is a side elevation view of the cart shown in FIG. 1 with the leg support in a raised position.

The sequence of FIGS. 1–4 shows the successive changes in the configuration of cart 50 from a chair configuration to a bed configuration positioned on a raised platform. In FIG. 2, leg support frame 28 has been raised to a horizontal position. To load cart 50 on a raised platform such as the rear end of a conventional station wagon or ambulance, the occupied cart 50 is moved forward until auxiliary wheels 31 can be placed on the raised platform. Typically, handle 11 is used to apply a downward pressure to the rear of cart 50 thus slightly raising auxiliary wheels 31 to the height of the raised platform. The load is now supported on auxiliary wheels 31 and rear legs 13.

Handle 11 can now be released and rotated about pivot rod 12 so front legs 6 are rotated backward and upward and back frame 4 is rotated backward and downward. That is, catch 54 on handle 11 can be released, and the handle 11 and extension 10 can be pivoted towards the horizontal thus also pivoting front legs 6 and back frame 4 towards the horizontal. In the embodiment shown in FIGS. 6, 7 and 11, catch 157 is released and rod 112 slides rearward along the slot 159, thus raising front legs 6 and lowering back frame 4. Otherwise the loading and unloading of cart 50*a* is similar to the loading and unloading of cart 50. Cart 50 can now be moved further along forward onto the raised platform and the forwardmost two of wheels 38 are positioned on the raised platform. Referring to FIG. 3, as cart 50 is moved further onto the raised platform, the rearwardmost two of wheels 38 also come to rest on the platform. The weight of occupied cart 50 is now resting on wheels 19 and auxiliary wheels 31 and 38. Accordingly, rear legs 13 can be pivoted upward and retracted so that cart 50 can be pushed further along the raised platform. FIG. 4 shows cart 50 in a bed position located completely on the raised platform. During the loading process when cart 50 is in neither the chair position nor the bed position, handle 11 still remains in a position for guiding cart 50. This is advantageous because good control is particularly desirable during the movement of the cart from the ground to a raised platform.

Referring to the third embodiment shown in FIGS. 10–14, the loading and unloading procedure takes advantage of the screw drive for raising the hinged leg support assembly 51*a* and for extending the rear legs of cart 50*b*. More specifically, cart 50*b* is rolled to the rear of a stationwagon with the door or hatch open. By means of a hand crank at the rear of cart 50*b*, screw 284 is turned and leg support assembly 51*a* is raised to a substantially horizontal position. The cart is moved forward and the front end is raised so that small wheels 231 at the end of frame 228 can be placed on the wagon floor. This can be done by manually lifting the front end or by using handles 211 and foot assist bar 280 to tilt the cart backward. An extension power cord connected to the 12-volt supply in the car is brought out and plugged into the connector in the rear panel (or side panel) on the cart. The selector switch 276 is moved to and held in the RAISE position to extend the rear legs, thus raising the cart to a level position. Catches 157 that lock rod 112 just behind the back support are released, and handles 211 are brought backward and downward, thus raising front legs 6 until front leg cross bar 253 latches against the bottoms of side panels 203. In so doing, the back frame 4 is lowered to a reclining position so that a cart occupant will have adequate head clearance at the door opening. With the load being borne by wheels 231 on the leg rests and by rear wheels 19, the cart is moved forward as far as possible into the car. The control switch then is held in the LOWER position thereby lowering the cart until the load is transferred from rear wheels 19 to the auxiliary wheels 38 under seat 2. Catches 241 on rear leg brackets 216 are released, and rear legs 13*a* are raised rearward to a horizontal position. The cart now can be rolled all the way into the car. The reverse of this procedure is followed in removing the cart and patient from the car.

Various modifications and variations will no doubt occur to those skilled in the various arts to which this invention pertains; for example, the particular coupling between the rear legs and the seat frame may be varied from that disclosed herein. Such a variation and all other variations which basically rely on the teachings through which this disclosure has advanced the art are properly considered within the scope of this invention.

The embodiments of the invention in which an exclusive property or privilege is claimed are defined as follows:

1. A cart convertible between a chair position and a bed position of reduced vertical height with respect to the chair position; said cart including first and second movable supporting legs downwardly depending when the cart is in the chair position and in a retracted position when the cart is in the bed position; said first leg being positionable in said retracted position when said second leg is positioned in said downwardly depending position; said cart including an occupant support portion positionable to function as the back when the cart is in the chair position and to be in a retracted supporting position when the cart is in the bed position; said cart including a first adjustment means coupling said occupant support portion and said first leg for simultaneously moving said first leg and said occupant support portion toward the retracted positions of said first leg and said occupant support portion.

2. A cart as recited in claim 1 wherein said first adjustment means is pivotally coupled to said occupant support portion and said first leg; said occupant support portion is pivotably coupled to said cart and said first leg is pivotably coupled to said cart, thereby retracting from said chair position to said bed position by rotation.

3. A cart as recited in claim 2 wherein said second leg includes a second adjustment means for positioning said second leg in the retracted position, said second adjustment means being operable independently of said first adjustment means.

4. A cart as recited in claim 3 further comprising a retraction means coupled to said second leg for increasing and decreasing the length of said second leg for facilitating movement of said cart between the ground and a raised platform.

5. A cart as recited in claim 4 wherein said retraction means includes a pair of telescoping tubes extendable and retractable by a screw means.

6. A cart as recited in claim 5 further comprising an electric drive motor coupled to said screw means for providing power to turn said screw means, said motor being adapted to be coupled to the electrical system of an automobile.

7. A cart as recited in claim 4 further comprising a leg rest pivotally coupled to said chart and being generally vertical in the chair position and generally horizontal in the bed position.

8. A cart as recited in claim 7 further comprising a screw drive means coupled to said leg rest for adjusting said leg rest between said chair position and said bed position.

9. A cart as recited in claim 8 further comprising a roller means on the underside of said leg rest for resting on a raised platform and facilitating positioning the cart on the raised platform.

10. A cart as recited in claim 8 wherein said first adjustment means includes a handle pivotally coupled to said occupant supporting portion forming the back of said cart and said first leg for simultaneously moving said first leg and said supporting portion to the retracted position, said handle extending generally along the side of said cart; a guide means coupled to said cart for guiding the movement of said handle when positioning the cart between the chair position and the bed position; and a releasable restraining means for securing said handle when said cart is in the chair position.

11. A cart convertible between a chair position and a bed position comprising:

a seat frame means for providing a supporting platform for a cart occupant;

a back frame means pivotally coupled to said seat frame means for providing a generally upright back support in said chair position and a generally horizontal back support in said bed position;

a forward pair of legs coupled to said seat frame means so said forward pair of legs can be retracted;

a rearward pair of legs coupled to said seat frame means so that said rear pair of legs can be retracted; and a cart adjustment means coupled to said forward pair of legs and to said back frame means so that said back frame means can be adjusted from said chair position to said bed position as said front pair of legs is retracted whereby the forward portion of said seat frame can be rested on a raised platform and the rearward portion of said seat frame can be rested on said pair of legs thus facilitating placing said cart on said platform and reducing the overhead clearance required above said raised platform; said cart adjustment means including an elongated handle means extending between said forward pair of legs and said back frame means along said cart, a first extremity of said handle means pivotally coupled to said forward pair of legs, a second extremity of said handle means pivotally coupled to said back frame means, whereby rotation of said handle toward the horizontal plane causes movement of said back frame means and said forward pair of legs toward the horizontal plane thereby converting said cart from the chair position to the bed position and whereby rotation of said handle away from the horizontal plane causes movement of said back frame means and said forward pair of legs away from the horizontal plane thereby converting said cart from the bed position to the chair position.

12. A cart as recited in claim 11 wherein said handle means includes a side member pivotally coupled to said seat frame, said side member including a pivot joint dividing said side member into a rearward portion and a forward portion, said rearward and forward portions rotating in opposite directions during adjustment of said cart between the bed position and the chair position.

13. A cart as recited in claim 11 further comprising: guide means at the side of said seat frame for coupling to said handle means for guiding relative movement between said handle means and said seat frame during adjustment of said cart between the bed position and the chair position.

14. A cart as recited in claim 11 further comprising:

a leg rest frame pivotally mounted to said seat frame means positionable between a generally horizontal orientation in the bed position and a generally vertical position in the chair position; and at least one leg frame wheel coupled to said leg rest frame for resting on the raised platform when said leg rest frame is in a generally horizontal position thereby facilitating movement of said cart onto the raised platform.

15. A cart as recited in claim 14 further comprising;

a forward and a rearward pair of auxiliary seat frame wheels coupled to said seat frame means adjacent said forward and rearward pair of legs, respectively, for resting on the raised platform when the adjacent pair of legs is rotated toward the horizontal retracted position of each of said forward and rearward pairs of legs associated with the bed position of said cart.

16. A cart as recited in claim 15 further comprising:

a lock plate coupled to said seat frame means including a slot through said lock plate, said lock plate being pivotable between a locked position and an unlocked position; and an elongated adjusting lock bar passing through said slot of said lock plate and pivotally coupled to said leg rest frame, whereby said adjusting lock bar freely passes through said slot when said leg rest frame is being rotated upward toward the horizontal bed position and said lock plate is positioned in said unlocked position, and said lock plate locks said adjusting lock bar when said leg rest frame is being urged downward toward a vertical chair position unless said lock plate is manually positioned in said unlocked position, thus providing for rotational adjustment of said leg rest frame.

17. A cart as recited in claim 13 wherein said guide means includes an elongated slot with a cooperating pivotally mounted lock bar, said lock bar pivotable to align with said slot and block movement of said handle means along said slot, thus locking said handle means when said cart is adjusted in the chair position.

18. A cart convertible between a chair position and a bed position having a forward and a rearward pair of legs; a chair back frame coupled to said forward pair of legs so said chair back frame and said forward pair of legs adjust toward generally horizontal positions thereby facilitating controlled positioning of said cart on a raised platform with limited overhead clearance, the adjustment of said chair back frame and said forward pair of legs being controlled by an adjustment means including a handle means extending from said forward pair of legs to said chair back frame; a movable leg rest positionable between a generally vertical position in the chair position and a generally horizontal position in the bed position; roller means coupled to said cart adjacent the horizontal plane defined by the bed position of said cart for facilitating movement of said cart along a raised platform; said rearward pair of legs being adjustable toward a horizontal position; and the movement of the bottom of said rearward and forward pair of legs, during conversion between the bed position and the chair position, being generally in a direction opposite to the direction of movement of said cart onto the raised platform thus facilitating the sequential shift of cart support from said legs to the raised platform.

19. A cart as recited in claim 18 wherein the length of said rearward pair of legs is adjustable thereby providing a support of adjustable height during movement of said cart between the raised platform and the ground and limiting the support needed to be supplied by a cart operator.

* * * * *